US006663182B1

(12) United States Patent
Dolci et al.

(10) Patent No.: US 6,663,182 B1
(45) Date of Patent: Dec. 16, 2003

(54) ADJUSTABLE ARMREST FOR CHAIRS

(75) Inventors: Pierluigi Dolci, Marostica (IT); Antonio Dolci, Marostica (IT)

(73) Assignee: Plasticline Srl, Nove (IT)

( * ) Notice: Subject to any disclaimer, the term of this patent is extended or adjusted under 35 U.S.C. 154(b) by 0 days.

(21) Appl. No.: 10/199,051

(22) Filed: Jul. 22, 2002

(51) Int. Cl.[7] ..... A47C 7/54
(52) U.S. Cl. ..... 297/411.35
(58) Field of Search ..... 297/411.35, 411.37, 297/383

(56) References Cited

U.S. PATENT DOCUMENTS 5,407,249 A * 4/1995 Bonutti ..... 297/411.35
5,439,268 A * 8/1995 Dozsa-Farkas ..... 297/411.35
5,752,683 A * 5/1998 Novis et al. ..... 297/411.36
5,927,811 A * 7/1999 Tseng ..... 297/411.35
5,931,536 A * 8/1999 Wu ..... 297/411.35
6,053,578 A * 4/2000 van Hekken et al. ... 297/411.35
6,213,556 B1 * 4/2001 Chen ..... 297/411.35
6,502,904 B1 * 1/2003 Hansen ..... 297/411.35

* cited by examiner

*Primary Examiner*—Peter R. Brown
(74) *Attorney, Agent, or Firm*—Dykema Gossett PLLC

(57) ABSTRACT

An armrest (1) for a chair (S) including an upright element (2) substantially vertical provided in the lower part (2*a*) with fixing means (3) to a seat (L) of said chair (S) and supporting in the higher part (2*b*) an armrest element (4). The upright element (2) and the armrest element (4) are coupled through sliding means (5) suitable to allow the movement of the armrest element (4) in order to vary the distance of the front end (4*a*) of said armrest element (4) as regards the front end (A) of the seat (L).

7 Claims, 7 Drawing Sheets

ADJUSTABLE ARMREST FOR CHAIRS

The invention concerns an adjustable armrest for chairs, especially suitable to be applied to office chairs.

As it is known, armrests for chairs are formed by an armrest element that is supported by an upright element connected to the seat through appropriate fixing means.

Some types of chairs are provided with armrests that are adjustable in height in order to adapt the rest position of the arm according to the user's needs.

The chairs must have a size and a shape in keeping with specific national and/or international sets of rules.

There are for example specific sets of rules concerning the distance of the front end of the armrest element as regards the front end of the seat.

In particular the regulation ANSI BIFMA prescribes that such distance must not be shorter than 100 mm.

Besides the set of rules NEN, in force in Holland, establishes instead for such distance a minimum value of 200 mm.

The necessity of respecting these different sets of rules compels the builders to realize the same chair model with the armrests placed at different distances.

In order to obtain these conditions, it is necessary to provide on the seat, or anyway in the hooking points of the armrest fixing means, for differentiated perforations, so that the same chair model can receive the same armrest model however fixed in different positions.

The aim the present invention is to obviate to the said drawback.

In particular an aim of the invention is that of realizing an armrest allowing the chairs equipped with it, to be in keeping with the sets of rules, in force in the different countries, as for the distance of the front end of the armrest element as regards the front end of the seat.

The said aim is attained through the realization of a seat for a chair that according to the main claim, includes an upright element substantially vertical provided in the lower part with fixing means to a seat of said chair and supporting in the higher part an armrest element, and wherein said upright element and said armrest element are coupled through sliding means suitable to allow the movement of said armrest element in order to vary the distance of the front end of said armrest element as regards the front end of said seat.

According to a preferred embodiment, said sliding means are formed by an annular edge bordering said higher part of said upright element, which is housed slidingly in a guide track obtained inside said armrest element.

Suitable locking means allow to fix the armrest element in the reached position.

Advantageously the invention allows to standardize the production without providing for differentiated perforations of the seat in order to fix the armrest at different distances as regards the front end of the seat. In such a way the same chair with the same armrests is in conformity with the different sets of rules in force in different countries.

Still advantageously the possibility of regulating the position of the armrest can be useful to insert partially the seat under the desk, when its height is lower than the armrest one.

The said aims and advantages will be better underlined during the description of a preferred embodiment of the invention shown approximately but not restrictively referring to the enclosed drawings where:

Figure 1:
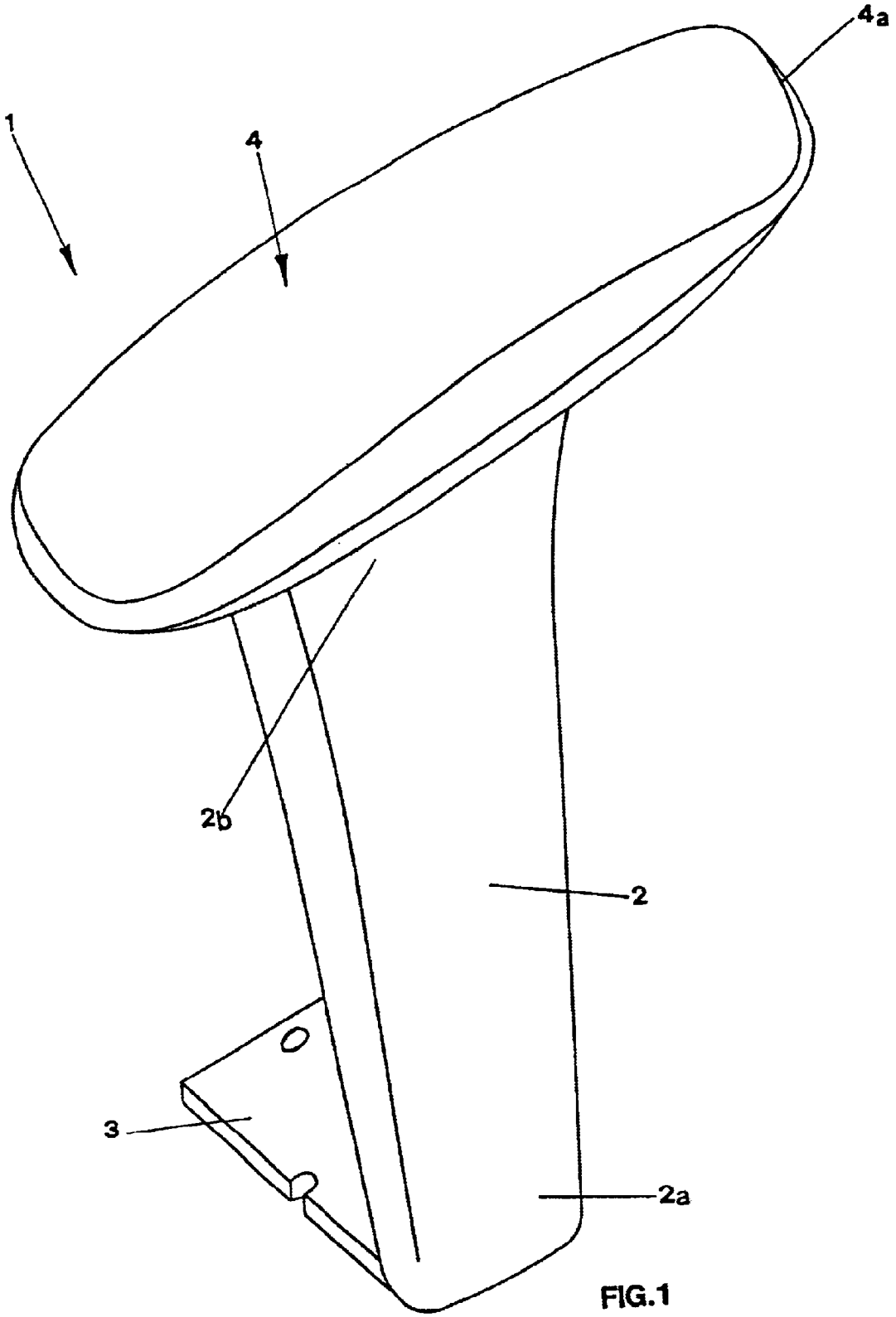
FIG. 1 shows the armrest of the invention in a perspective view.
Figure 6:
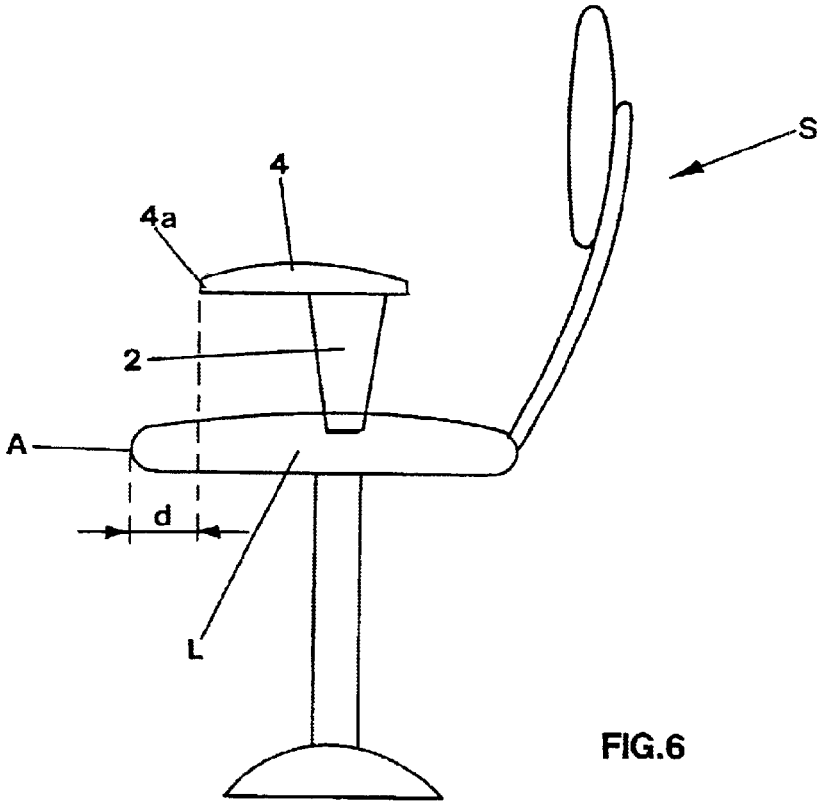
FIGS. 6 and 7 show the armrest of the invention applied to a chair in two different positions.
Figure 7:
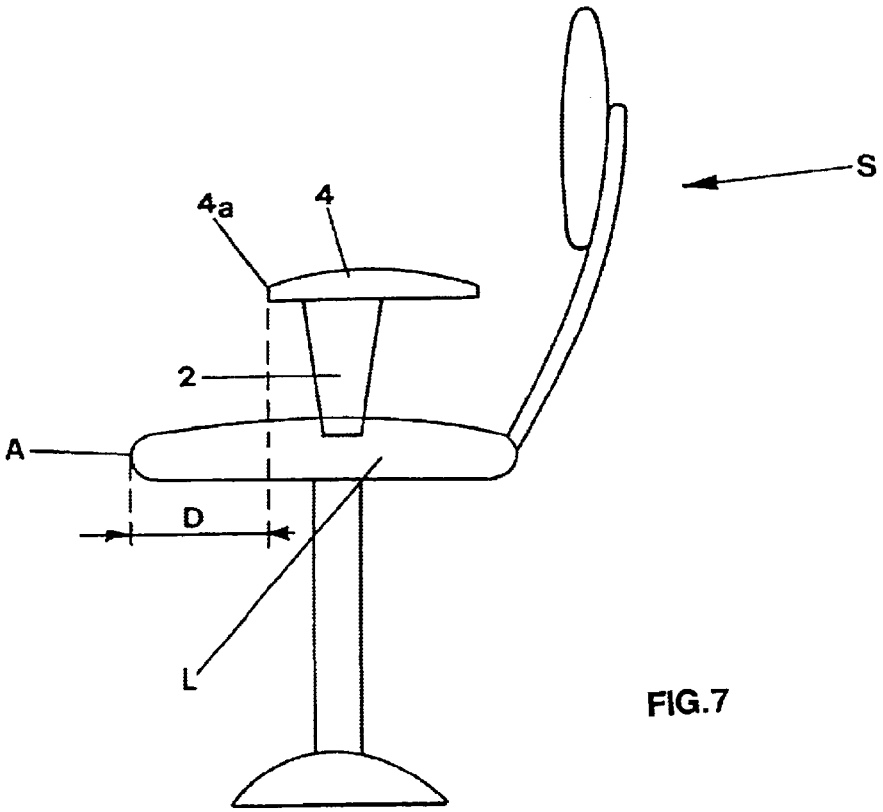

As it can be observed in FIG. 1 and also in FIGS. 6 and 7, the armrest, object of the invention and marked with 1 as a whole, includes an upright element 2 substantially vertical provided in the lower part 2*a* with a bracket 3 for fixing a chair S to the seat L and in the higher part 2*b* of an armrest element 4.

According to the invention, the upright element 2 and the armrest element 4 are coupled through sliding means 5 that are suitable to allow the movement of said armrest element 4 in order to vary the distance of the front end 4*a* of said armrest element 4 as regards the front end A of said seat L.

Figure 2:
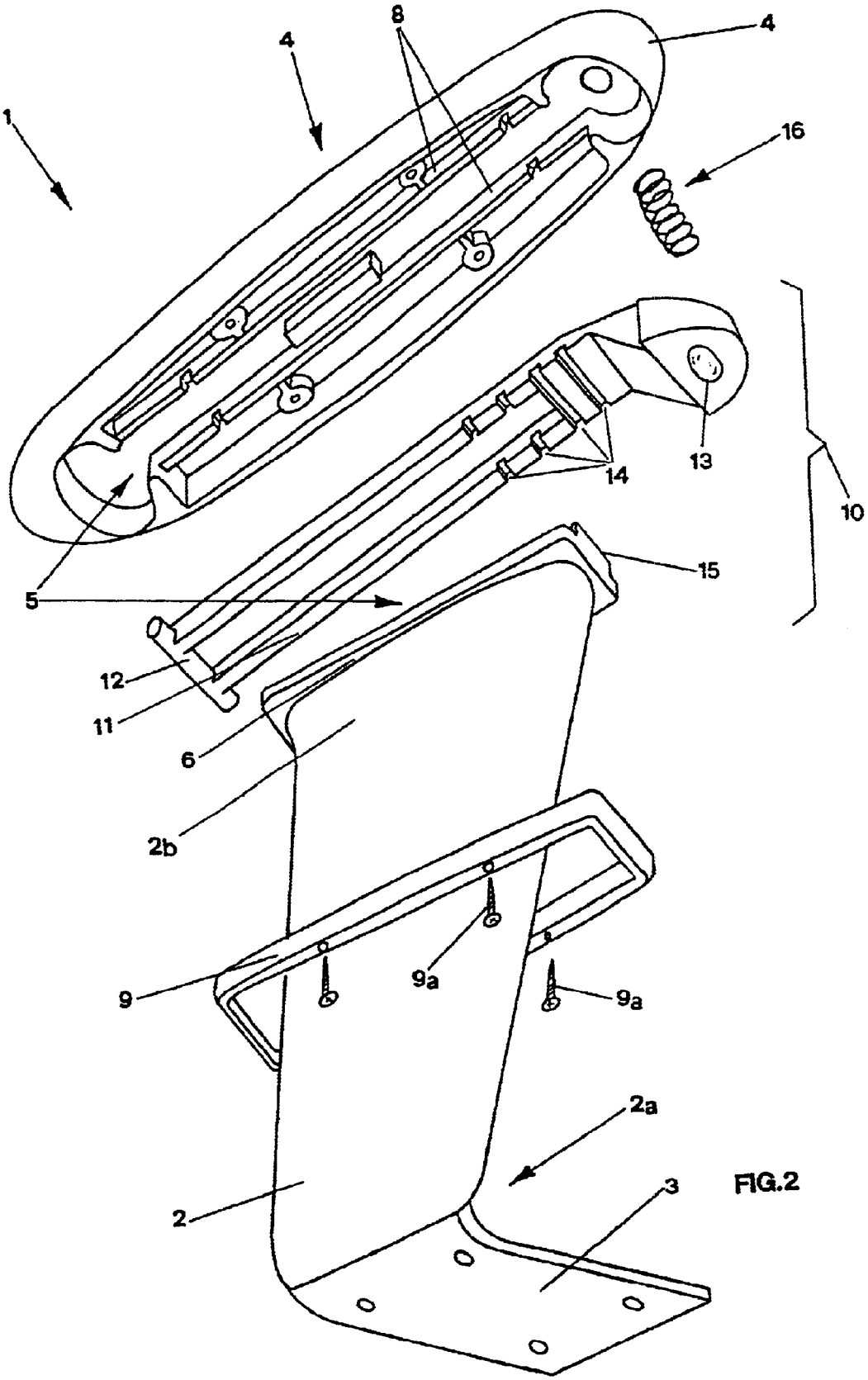
FIG. 2 shows the armrest of FIG. 1 in an exploded perspective view.
Figure 3:
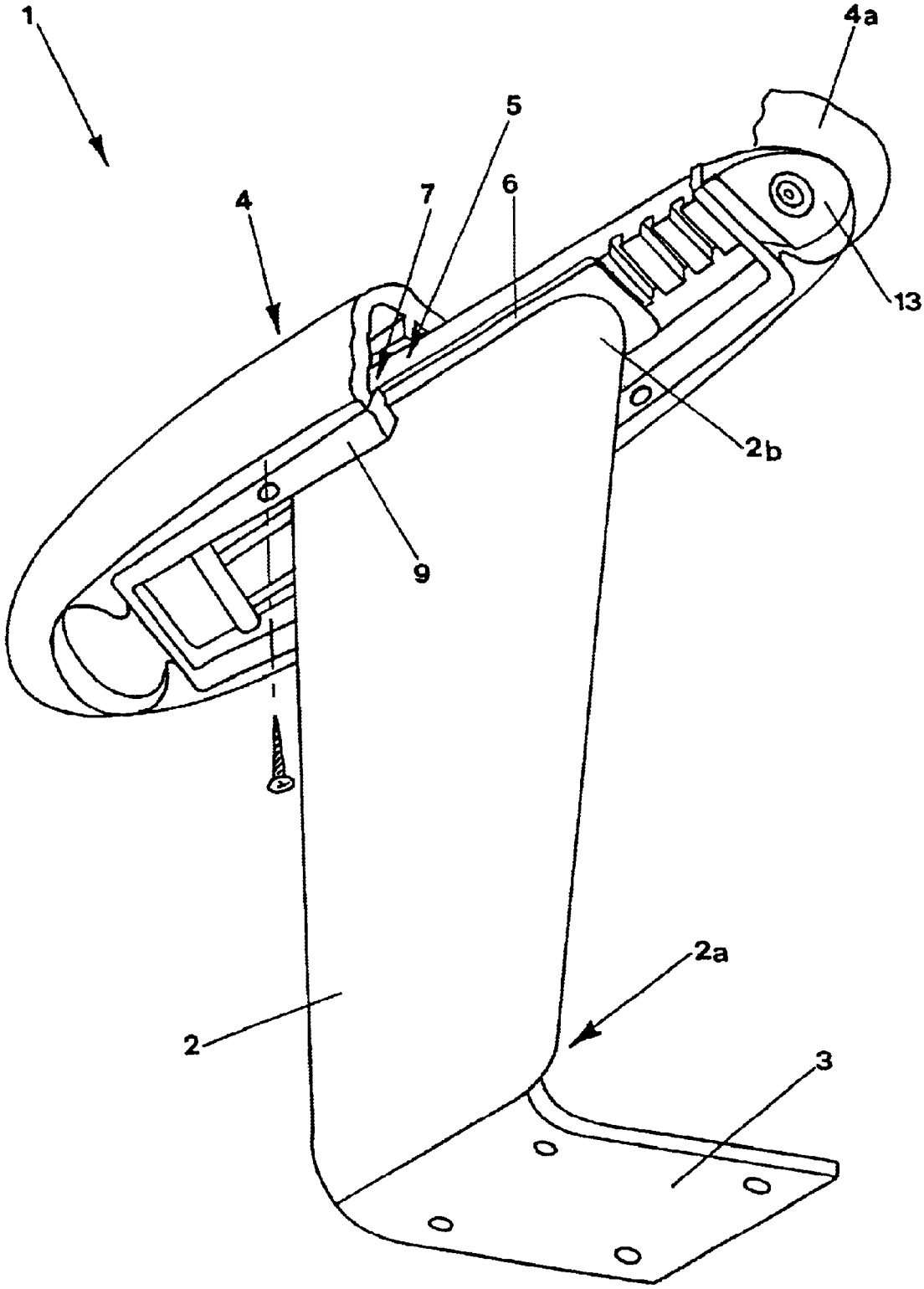
FIG. 3 shows the armrest of FIG. 1 in a partially sectioned perspective view.
Figure 4:
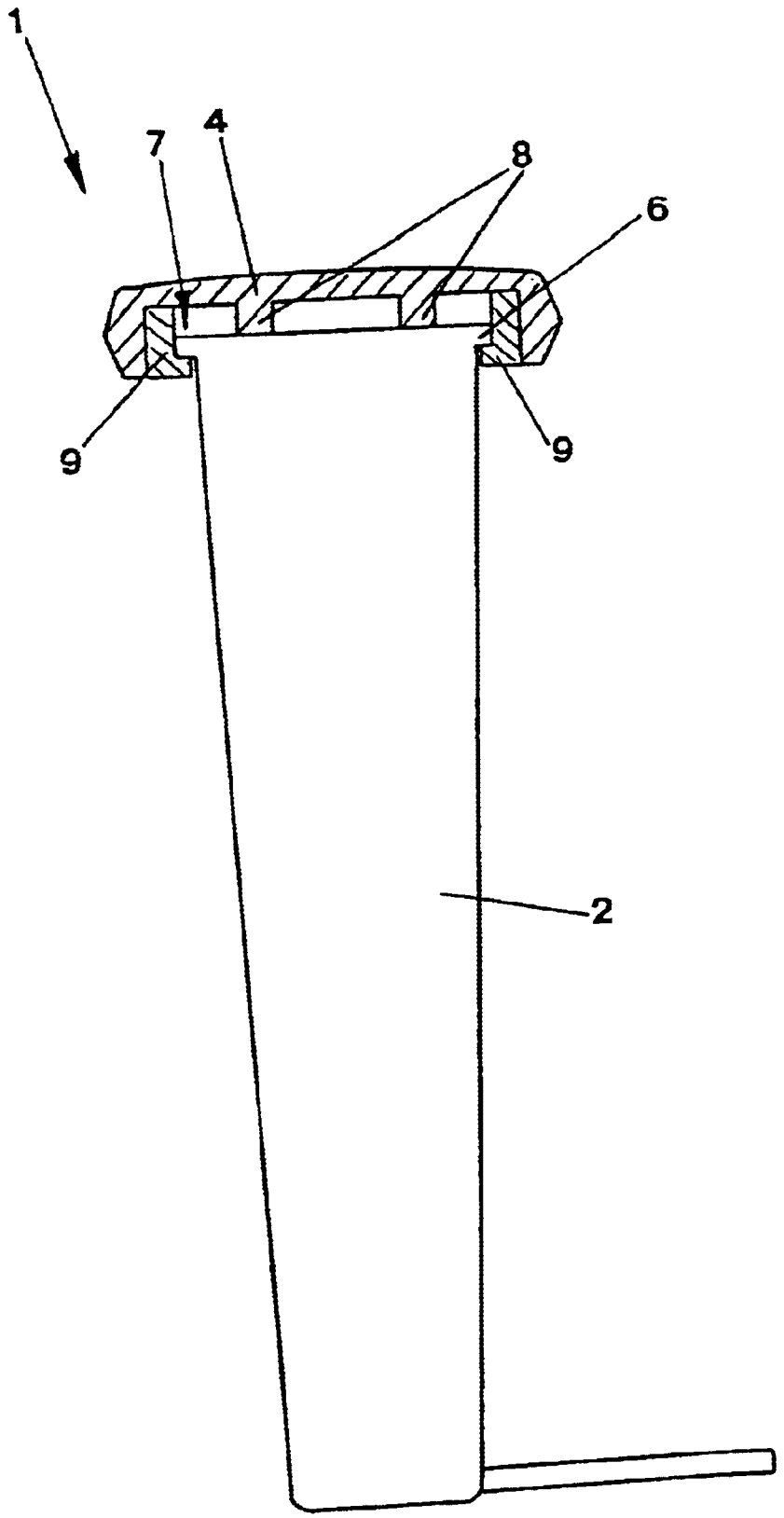
FIG. 4 shows the armrest of FIG. 1 in a cross section.

According to the preferred embodiment shown and described, later on, the sliding means 5 are formed, as it is underlined also in FIGS. 2 and 3, by an annular edge 6 bordering the higher part 2*b* of said upright element 2, which is slidingly housed in a guide track 7, particularly evident in FIG. 4, obtained inside the armrest element 4.

Such guide track 7 is defined between a couple of overhanging longitudinal ribs 8 present inside said armrest element 4 and an annular flange 9 removably coupled to the armrest element 4. Such annular flange 9 is opposed to the longitudinal ribs 8 and is placed through a beat below said annular edge 6 and therefore is fixed to the armrest element 4 through fixing means that can be, for example, screws 9*a*. Suitable locking means, marked with 10 as a whole in FIG. 2, make the armrest element 4 stable in different adjustment positions.

Figure 5:
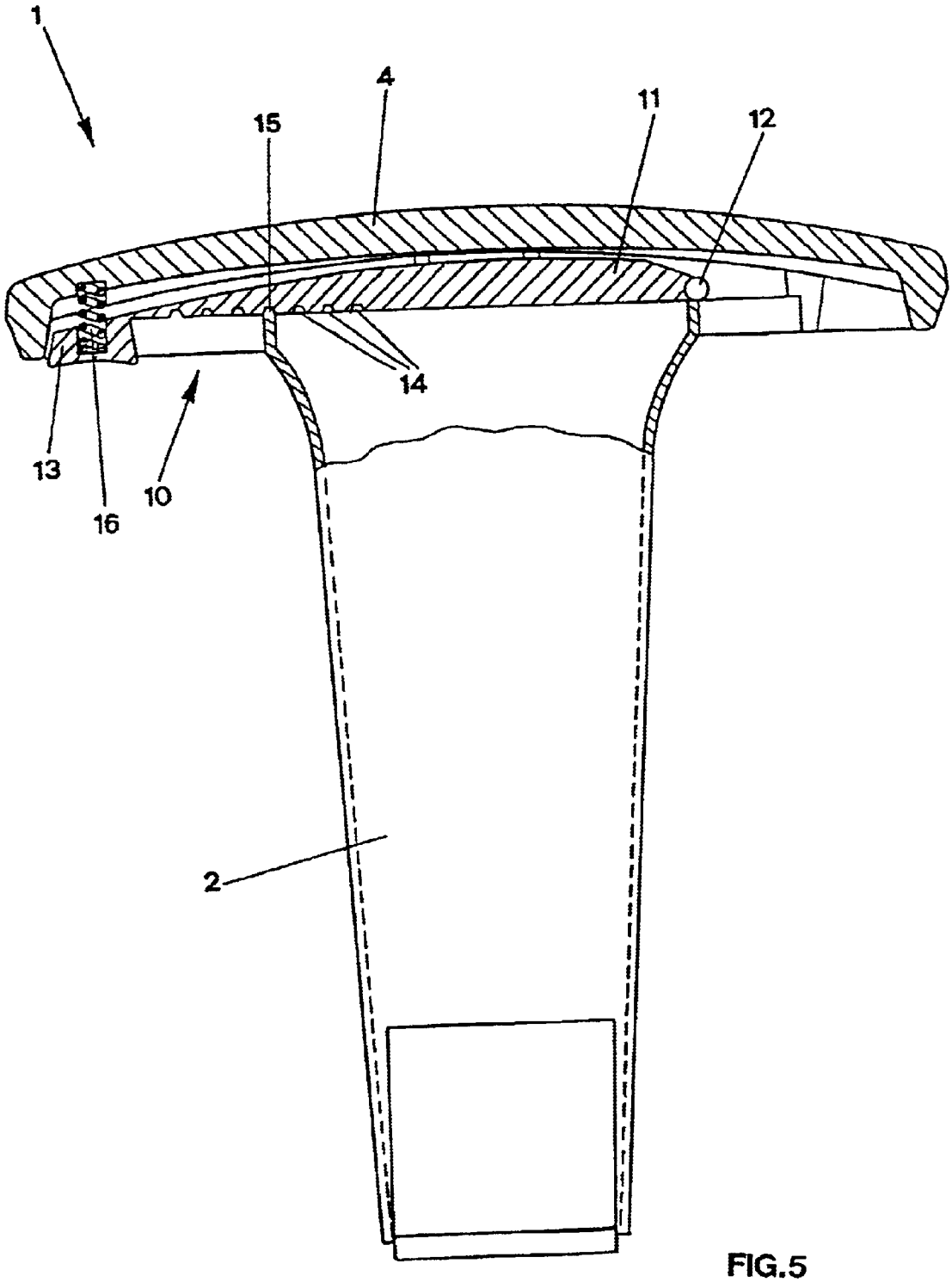
FIG. 5 shows the armrest of FIG. 1 in a longitudinal section.
Figure 5A:
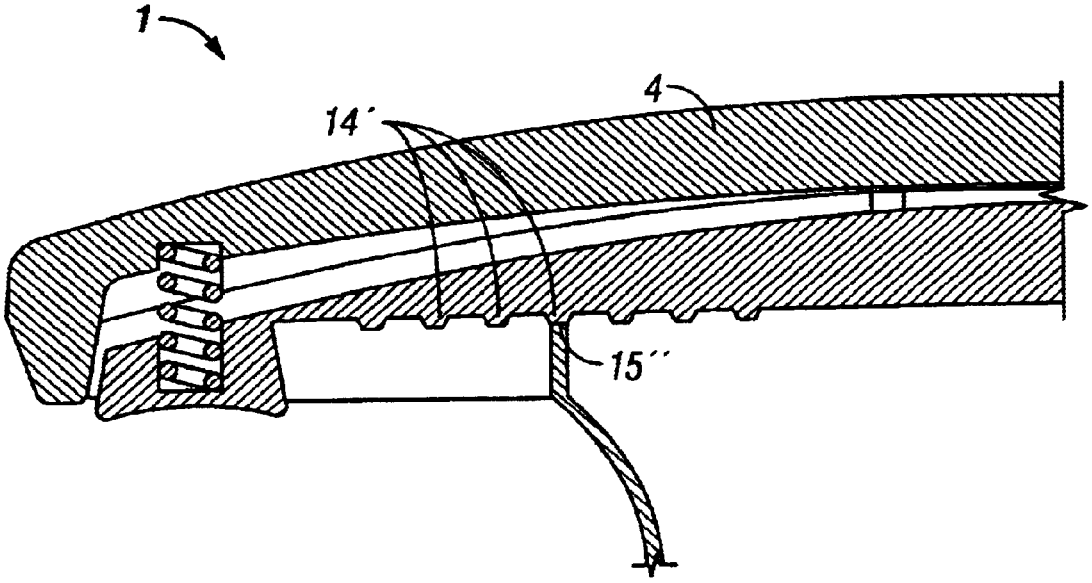
FIG. 5A shows alternative embodiment of the arrangement illustrated in FIG. 5.

Such locking means 10, as it can be observed also in FIG. 5, include a lever 11 that is inserted between the longitudinal ribs 8, developing longitudinally to the armrest element 4 and provided at its end with a fulcrum pin 12 and at the opposite end with a move push button 13, projecting and accessible for the operator.

The lever 11 also has a plurality of hollows or slots 14 placed on its length, each one being suitable to house a tooth 15 belonging to the annular edge 6 of said upright element 2.

As an alternative, a plurality of teeth 14' can be placed along the lever 11, while a slot 15" suitable to cooperate with them, can be formed on the annular edge 6 of the upright element 2.

Between the lever 11 and the armrest element 4 there are elastic means that preferably are formed by an helical spring 16 with a cylindrical section, connected to the move push button 13.

It is evident that the elastic and locking means could be different from the ones that have been shown.

Operationally, when the armrest element 4 is rest position, it made to be fixed by the locking means 10, since the tooth 15 of the annular edge 6 of the upright element 2, is housed in one of the hollows 14 of the lever 11.

In order to shift it, it is necessary to press the push button 13, so as to rotate the lever 11 around the fulcrum 12 and lift it until the tooth 15 is unhooked from the respective hollow.

After having placed through a sliding the armrest element 4 in the new wanted position, in order to lock it is sufficient to release the push 13 and automatically the lever 11, pushed by the elastic element 16, hooks the tooth 15 in the nearest hollow 14.

Different operational positions of the armrest of the invention assembled on a chair S are shown in FIGS. 6 and 7.

In particular, in FIG. 6 it can be observed that the armrest element 4 is placed with the end 4*a* in a totally advanced position, while in FIG. 7 it can be observed that the armrest element 4 is placed with the end 4*a* in a totally rear position, corresponding to the shortest distance d and longest distance D as regards the front end A of the seat L.

For example, between the shortest distance d and the longest distance D, the shortest distance of 100 mm provided for by the regulation ANSI BIFMA and the shortest distance of 200 mm provided for by the set of rules NEN can be included.

The possibility of moving the armrest element 4 allows, besides respecting the distances forced by the different sets of rules, inserting the chair under the desk too, avoiding the interference of the armrest element with the desk.

The armrest of the invention can advantageously be provided with further devices, as for example devices suitable to adjust the height of the armrest element as regards the seat plane.

As for the materials, the armrest can be built with any type of material according to the particular use it is intended for.

According to what has been described it can be understood that the adjustable armrest, object of the invention, attains the prearranged aim.

It is intended that the executive variants that have not been shown and described and that could be brought to the armrest of the invention, since they are based on the same claimed resolving idea, are to be considered all protected by the present patent.

What is claimed is:

1. The armrest for a chair having a seat portion with a front end comprising an upright element having upper and lower ends;

a bracket extending from the lower end for securing the upright element to the seat;

an armrest element having a front end and being supported at the upper end of the upright element;

a sliding element for slidingly connecting the upright element and the armrest element to allow relative movement therebetween in order to vary a horizontal distance between the front end of the armrest and front end of the seat; and the sliding element including an annular edge at the upper end of the upright element and a guide track formed on the lower side of the armrest element for slidingly receiving the near edge therein, said guide track further including at least two longitudinal ribs extending from the underside of the armrest element and an annular flange removably coupled to the armrest element in opposition to the longitudinal ribs.

2. The armrest according to claim 1, wherein said annular flange is located below the annular edge of the upright element and is secured to the armrest element.

3. The armrest according to claim 1, including locking means for securing the armrest element in a plurality of stable positions relative to the upright element.

4. The armrest according to claim 3, wherein the locking means includes a lever having front and rear ends, a fulcrum located at the rear end and a movable push button and the front end, said lever and upright element having complimentary removably engageable slotted portions and at least one detent portion engageable with the slotted portions.

5. The armrest according to claim 4, including an elastic element located between said removable push button and the armrest element for balancing the front of the armrest element and the front end of the lever.

6. The armrest according to claim 5, wherein the elastic element comprises a helical spring and a cylindrical portion for engaging to push button.

7. The armrest according to claim 4, wherein said slided elements comprise slotted portions formed in the underside of the lever and the detent portion comprises an upstanding element projecting from the annular flange for engaging the slots.

* * * * *